United States Patent [19]

Bolbochan et al.

[11] 3,931,605

[45] Jan. 6, 1976

[54] HIGH-VOLTAGE RESISTOR UNIT

[76] Inventors: Vasily Fedorovich Bolbochan, ulitsa Kuibysheva, 119, kv. 88, Kishinev; Anatoly Viktorovich Vorobiev, prospekt Nauki, 6/1, kv. 78, Leningrad; Ivan Fedorovich Drabenko, ulitsa Dimo 9/3, kv. 41, Kishinev, all of U.S.S.R.

[22] Filed: Jan. 9, 1974

[21] Appl. No.: 431,974

[52] U.S. Cl. ..... 338/64; 338/261; 338/320

[51] Int. Cl.[2] ..... H01C 1/06

[58] Field of Search ..... 338/320, 295, 260, 261, 338/64

[56] References Cited

UNITED STATES PATENTS 2,154,685 4/1939 Lamb ..... 338/64

*Primary Examiner*—E. A. Goldberg

*Attorney, Agent, or Firm*—Haseltine, Lake & Waters

[57] ABSTRACT

A high-voltage resistor unit comprising a chain of seriesconnected resistors in the form of hollow cylinders, each cylinder having a winding. Each resistor in the chain is provided with a screen in the form of a hollow cylinder with an additional winding enveloping the winding of the resistor in such a way that the potential at each point of said additional winding is equal to that at the respective point of the resistor winding. The additional winding also serves as a leaktight envelope for the resistor winding, protecting it from a liquid dielectric, placed wherein are said resistors with said screens.

2 Claims, 1 Drawing Figure

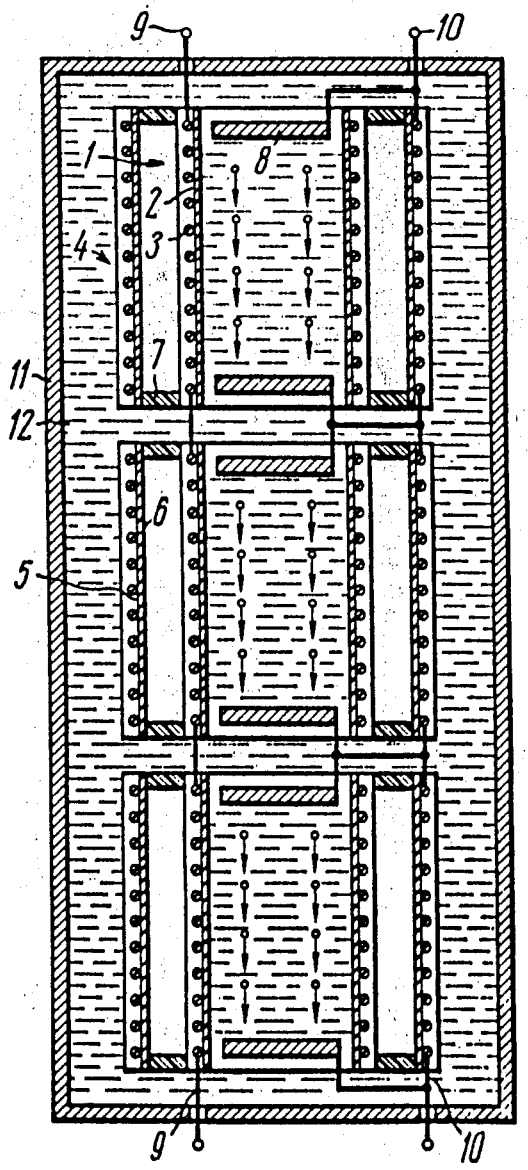
9
10
1
8
2
3
4
7
11
12
6
5
9
10

HIGH-VOLTAGE RESISTOR UNIT

The present invention relates to high-voltage measuring equipment and more particularly to a high-voltage resistor unit operating in a liquid dielectric and used primarily to carry out precision measurements in metrology, instrument making and power engineering.

Known at present is a high-voltage resistor unit comprising a screened chain of series-connected resistors made in the form of hollow cylinders with a microwire winding, which are placed in a metal casing filled with a liquid dielectric.

The shielding of the entire chain of resistors in the foregoing unit is performed with the aid of one screen in the form of a leaktight cylinder whose outer surface has a high-resistance conducting coating. Said resistor unit has the following disadvantage: although the transverse charge transfer is ruled out in this unit by the fact that the dielectric has no access to the winding, this is not the case with the longitudinal charge transfer between the ends of each resistor. The latter transfer produces an unstable shunting effect upon the resistor, especially when its resistance differs by only one or two orders from the resistivity of the liquid dielectric or when a high voltage is applied to the resistor.

Another disadvantage of the known unit is the fact that the chain of resistors is completely sealed off by the screen, which seriously impedes heat exchange between the resistor unit and the surrounding medium. As a result, the given resistor unit can only be used in low-power circuits.

It is an object of the present invention to provide a high-voltage measuring unit which would rule out the shunting effect of the liquid dielectric, due to longitudinal charge transfer therein, and would improve heat exchange with the surrounding medium.

The foregoing object is attained due to the fact that in a high-voltage resistor unit comprising a chain of series-connected resistors made in the form of hollow cylinders with a microwire winding placed in a metal casing filled with a liquid dielectric, screening is performed, in accordance with the invention, with the aid of series-connected screens, there being one screen per each resistor, the screens being made in the form of hollow cylinders with an additional winding enveloping the resistor winding in such a way that the potential at each point of said additional winding is approximately equal to that at the respective point of the resistor winding, the additional winding also serving as a leaktight envelope for the resistor winding to protect it from the liquid dielectric.

It is expedient that the high-voltage resistor unit be provided with electrodes in order to prevent the resistors from being shunted by the dielectric, the electrodes being placed inside the hollow cylinders, in immediate promixity to the end faces thereof, and being electrically connected to the additional winding.

The proposed high-voltage resistor unit is capable of maintaining, with high precision, the value of its electrical resistance, which means, in the final analysis, that it is marked by high accuracy of performance.

The present invention will now be explained in greater detail with reference to a specific embodiment thereof taken in conjunction with the accompanying drawing showing a diagram of the proposed high-voltage resistor unit (longitudinal section).

Referring now to the attached drawing, the proposed high-voltage resistor unit comprises three series-connected resistors 1. Each resistor 1 is made in the form of a hollow cylinder 2 with a microwire winding 3 and is provided with a screen 4 made in the form of a hollow cylinder 5 of a greater diameter, the latter cylinder being provided with an additional microwire winding 6 enveloping the winding 3 of the resistor 1. There is an air gap between the screen 4 and the resistor 1. The distribution of the resistance of the screen 4 over the length of the cylinder 5 corresponds to the distribution of the resistance of the resistor 1 over the length of the cylinder 2 thereof.

The leaktightness of the winding 3 of the resistor is ensured by means of ring packings 7 made of an epoxy compound.

The "resistor 1 — screen 4" unit is provided with a pair of additional electrodes 8 in order to prevent the resistors from being shunted by the dielectric, said electrodes being placed inside the hollow cylinder 2, in immediate proximity to the end faces thereof, and being electrically connected to the winding 6 of the screen 4.

The windings 3 of the resistors 1 are interconnected in series and provided with leads 9. The windings 6 of the screen 4 are interconnected in the same manner and provided with leads 10.

The resistors 1 with the screens 4 and the electrodes 8 are placed in a metal casing 11 filled with a liquid dielectric 12, the dielectric being insulation oil.

The proposed high-voltage resistor unit operates as follows.

As voltage is applied to the leads 9 and 10, the additional electrodes 8 catch the longitudinal charge flow (shown by arrows in the drawing) of the liquid dielectric 12 and direct it to the winding 6 of the screen 5, thus preventing the resistor 1 from being shunted. No charge transfer takes place between the resistor 1 and the screen 4 due to the fact that the winding 3 of the resistor 1 is sealed off from the liquid dielectric 12. The latter effect is considerably enhanced by the fact that the winding 6 of the screen 4 is made in such a way that the potential at any point thereof is approximately equal to that at the corresponding point of the winding 3 of the resistor 1.

The proposed design of the resistor unit accounts for optimum conditions for heat dissipation, as the liquid dielectric is found both on the inner and outer surface of the "resistor 1 – screen 4" unit.

The proposed high-voltage resistor unit, whose resistor windings are made of a glass-insulated microwire with a rated resistance ranging from a few megohms to several thousand megohms, makes it possible to carry out different measurements, with direct current, with an error of 0.01 to 0.0001 percent. In integrated measuring systems, the proposed unit may be used as a primary resistor element for synthesis of high-voltage measuring voltage converters of the series resistor or voltage divider type, it may also be used to produce high-voltage voltage, resistance and power meters.

What is claimed is:

1. A high-voltage resistor unit comprising: a metal casing; a chain of series-connected resistors comprising hollow cylinders arranged in said case; microwire windings of said resistors wound on said hollow cylinders; series-connected screens separate for each of said resistors in the form of hollow cylinders with screening windings wound thereon, each of said screening windings enveloping the winding of each of said resistors so that the potential at each point of the screening winding is substantially equal to the potential at a corresponding point of said winding of said resistor; a liquid dielectric filling said metal casing; and the screen windings hermetically sealing the winding of each of said resistors from said liquid dielectric.

2. A high-voltage resistor unit as claimed in claim 1, including electrodes for protecting said resistors against being shunted by said dielectric, said electrodes being located inside said hollow cylinders of said chain of resistors in immediate proximity to their end faces and electrically connected to said screening windings.

* * * * *